US009027796B1

(12) United States Patent
Leitch

(10) Patent No.: US 9,027,796 B1
(45) Date of Patent: May 12, 2015

(54) TOOL TO AID IN THE CAULKING PROCESS

(71) Applicant: David M. Leitch, San Rafael, CA (US)

(72) Inventor: David M. Leitch, San Rafael, CA (US)

( * ) Notice: Subject to any disclaimer, the term of this patent is extended or adjusted under 35 U.S.C. 154(b) by 48 days.

(21) Appl. No.: 13/842,701

(22) Filed: Mar. 15, 2013

Related U.S. Application Data

(60) Provisional application No. 61/611,510, filed on Mar. 15, 2012.

(51) Int. Cl.
*B67D 7/06* (2010.01)
*B05C 17/005* (2006.01)

(52) U.S. Cl.
CPC ..... *B05C 17/0052* (2013.01)

(58) Field of Classification Search
CPC ..... B05C 17/0052; B05C 21/00
USPC ..... 222/192, 108, 148, 325–327, 386–393; 15/105, 236.01, 246, 257.01, 236.05, 15/244.1, 244.4, 105.5, 236.07, 118
See application file for complete search history.

(56) References Cited

U.S. PATENT DOCUMENTS

| | | | | |
|---|---|---|---|---|
| 5,429,678 | A * | 7/1995 | Fany | 134/6 |
| 6,067,683 | A | 5/2000 | Reeves | |
| 6,474,519 | B1 * | 11/2002 | Cleveland | 224/251 |
| 6,491,191 | B1 * | 12/2002 | Cleveland | 224/251 |
| 6,540,119 | B1 * | 4/2003 | Bensussan et al. | 222/464.3 |
| 7,127,769 | B2 * | 10/2006 | Chang et al. | 15/105 |
| 7,823,753 | B2 | 11/2010 | Kovac | |
| 8,701,237 | B2 * | 4/2014 | Brosche | 15/105 |
| 2004/0144804 | A1 * | 7/2004 | Borisch | 222/148 |
| 2006/0283891 | A1 * | 12/2006 | Kovac | 222/327 |
| 2013/0134182 | A1 * | 5/2013 | Brosche | 222/1 |
| 2013/0233345 | A1 * | 9/2013 | Baarsch et al. | 134/6 |

* cited by examiner

*Primary Examiner* — Frederick C Nicholas
*Assistant Examiner* — Patrick M Buechner
(74) *Attorney, Agent, or Firm* — Thomas M. Freiburger

(57) ABSTRACT

A flexible and resilient tool for use with a conventional half barrel, parallel frame caulking gun or enclosed "sausage" style caulking gun, aiding the user in finishing and shaping after the caulking material has been applied. One function of the tool is to collect excess caulk from his finger(s) or from various shaping tools and spatulas. Also provided can be cap, rag and sponge holders. Additional embodiments include adaptations to existing prior art disposable caulking cartridges and caulking guns to include components of the disclosed tool.

12 Claims, 12 Drawing Sheets

Embodiment 1

Embodiment 1

Embodiment 1

Embodiment 1

Embodiment 2

Embodiment 2

Embodiment 2

Embodiment 3

Embodiment 4

Embodiment 5

Embodiment 6

Embodiment 7

Embodiment 7

TOOL TO AID IN THE CAULKING PROCESS

This application claims benefit of provisional application No. 61/611,510, filed Mar. 15, 2012.

BACKGROUND OF THE INVENTION

The invention described below relates to hand tools and, more particularly, to caulking guns and associated tools used in the caulking process, or for other viscous sealants or adhesives.

Caulking guns, as they are generally known, comprise a class of construction and repair tools that expel caulk, sealant or other fill material for the purpose sealing and waterproofing joints that are likely to crack if filled with a rigid, non-flexible material. During the conventional caulking process, a bead of caulk is extruded from the caulking gun onto the desired location. Soon after the caulk has been applied, the user generally smooths and shapes the caulk with either his finger or one or more shaping tools. The caulking can be quite viscous and messy, which can result in unwanted deposits on unprotected surfaces or clothing. The excess caulk or sealant that has been shaped and removed collects on and adheres to the finger or tool. It is a general practice for the user to use a rag or other available implement, to wipe the excess caulk from his fingers or tools.

Reeves U.S. Pat. No. 6,067,683, the contents of which are expressly incorporated herein by reference, discloses a V-shaped receptacle for finger cleaning purposes which is held in a fixed position on the side of a caulking gun. While having the advantage to collect large amounts of excess caulking, due to its size and its mounted location, this device is likely to interfere with the caulking process and the user's ability to grasp the caulking gun effectively. The present invention provides an improved device that is less obtrusive while also providing a multitude of additional features and functions.

Kovac U.S. Pat. No. 7,823,753 provides for a single purpose tool holder, both magnetic and frictional in nature, (in combination with a double barrel caulking gun caddy) for shaping tools to be used for the smoothing and shaping process. While having a shaping tool accessible aids in one aspect of the caulking process, the present invention incorporates multiple implements and functions for the entire caulking process.

There is not found in the prior art, a combination caulking tool that can provide all the necessary implements for the entire caulking process. For the foregoing reasons, there has been a need for such a multi-purpose tool.

SUMMARY OF THE INVENTION

Two general classes of caulking guns are distinguished largely by whether or not they operate using disposable, pre-filled cartridges with built in nozzles or have fill material integral with the gun and utilize soft-sided packs. The current invention relates to a device consisting of multiple components that aids in the entire caulking process, and is adaptable to both styles of caulking guns. Additional embodiments include adaptations of the present invention to include new designs for disposable cartridges as well as caulking guns. The invention applies to other dispensers or "guns", for other sealants, adhesives, etc.

It is therefore an object of the present invention to provide a new caulking apparatus which "piggy-backs" onto a disposable cartridge or fill material style caulking gun and has many of the advantages of the finger cleaning device (U.S. Pat. No. 6,067,683) and tool holder (U.S. Pat. No. 7,823,753) mentioned heretofore. As such, the general purpose of the present invention, which will be described subsequently in greater detail, is to provide a new caulking gun apparatus, a new disposable cartridge design as well as a new caulking gun design which has many of the advantages of the finger cleaner and tool holder mentioned heretofore and many novel features that result in a caulking accessory which is novel and not suggested by any of the prior art finger cleaners or tool holders either alone or in any combination.

It is an object to provide a device of multiple functions that can be attached by various means including the use of friction or adhesive strips, directly or indirectly to a caulking tube or gun.

Another object is to provide a frictional holder for various shaping tools.

It is also an object of the current invention to include a towel/rag holder for a caulking gun.

It is also an object to include the attachment of a sponge or sponge like material.

Another object is to provide a holder for a cap or spout, so that when the user has finished the caulking process, the cap is readily available for resealing the caulking tube.

Another object of the invention is to position the components so that the accessory, tube or gun is easily adaptable to both right and left hand users.

It is also an object of the present invention to provide a caulking accessory which facilitates ease in operation and execution of the caulking process.

Another object of the invention is to allow the user to attach and remove the accessory with ease.

Still another object of the present invention is to provide a new caulking accessory allowing a user to function in an efficient manner such that productivity can be increased.

It is a further object of the current invention to include: a finger/tool, wiping fin, a rag, a cap/spout holder, a tool holder and a sponge on the apparatus for convenience, so that the user need not separately carry, or set down, the aforementioned implements which can inadvertently result in the deposit of caulk on unprotected surfaces.

A primary object of the current invention is to provide the capability of receiving and storing excess caulk during the caulking process.

A further object is to provide a means which will enable the user of a conventional caulking gun to quickly, easily and neatly clean his fingers or tools of excess caulk during the caulking process.

It is a further object of the present invention to provide a new caulking accessory, cartridge and gun which is of a durable and reliable construction.

A further object and advantage of the present invention is that the device is extremely lightweight with no noticeable increase in caulking gun weight.

An even further object of the present invention is to provide a new caulking accessory, cartridge and gun, which is capable of low cost of manufacture with regard to both materials and labor, and which accordingly can then be sold at low prices to the consuming public, thereby making such device economically available to the buying public.

A further advantage of the present invention is that the device is formed entirely of plastic, avoiding occurrence of rust.

Another object of the present invention is that shape, size, and location of the components do not interfere with the user's ability to perform the caulking process efficiently.

It is an object of the invention in Embodiments 1-4 described below, for the accessory to be held in a fixed position on the caulking cartridge or caulking gun.

Another object in the embodiments described below, is to provide a way and means of attaching implements and components including, but not limited to, "dove tail" or inverted "T" style splines.

Another object of the current invention of preferred embodiments, is to incorporate a method of frictionally attaching various replaceable components and implements to such an accessory, disposable cartridge or caulking gun.

Another object of the invention, as in Embodiments 3 and 4 below, is to allow the device to be frictionally or adhesively (i.e. peel and stick) attached, either singularly or in plurality, onto conventional "half-barrel" or open frame style caulking guns Another object of this invention is that it can be manufactured as a one piece, fixed accessory or manufactured in such a manner as to receive frictionally held, replaceable fins, components and accessories.

A further object of Embodiment 5 of the present invention described below is to adapt the aforementioned features to a thermally formed disposable cartridge of new design and manufacture that will accept the various components and implements specified in the previous embodiments.

It is another object of the present invention to apply the above features to a new design caulking gun (as in Embodiment 7 described below), manufactured to receive the same components and implements.

Still yet another object of the present invention is to provide a new caulking accessory, cartridge and gun which provides in the apparatus and methods of the prior art some of the advantages thereof, while simultaneously overcoming many disadvantages normally associated therewith.

As various changes could be made in the above construction without departing from the scope of the invention, it is intended that all matter contained in the above description or shown in the accompanying drawings shall be interpreted as illustrative and not in a limiting sense.

The accompanying drawings, which are incorporated in and constitute a part of this specification, illustrate a preferred embodiment of the invention and, together with the description, serve to explain the principles of the invention. Other objects, features, and advantages of the present invention will become more apparent from the following detailed description of the preferred embodiments and certain modifications thereof when taken together with the accompanying drawings.

DESCRIPTION OF PREFERRED EMBODIMENTS

Embodiment 1

Figure 1:
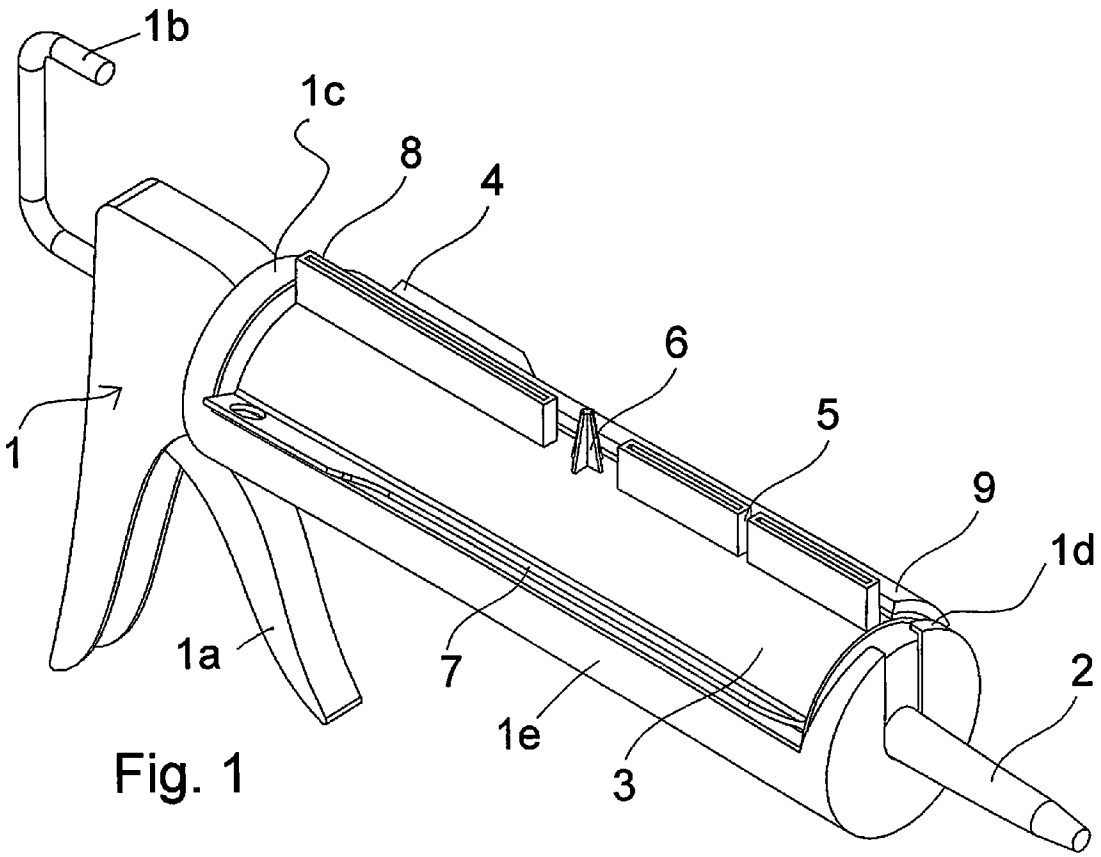
FIG. 1 is an isometric view of a caulking gun with the present invention attached on a disposable cartridge, in a first embodiment.
Figure 2:
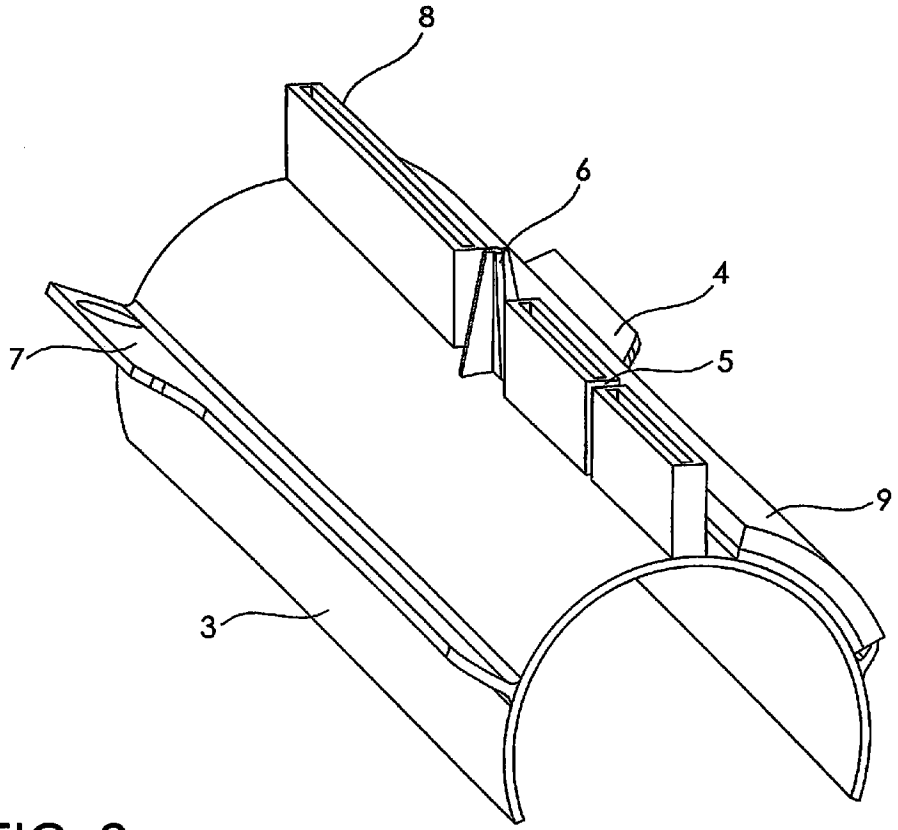
FIG. 2 is a stand alone isometric view of the accessory showing some of the possible components of the current invention.

Referring now to FIG. 1, a caulking, sealing or adhesive accessory 3 is shown mounted in a standard open-topped half barrel style caulking gun 1 with squeeze handle 1*a* and actuator 1*b*. Inserted into the standard gun is a conventional, disposable caulking tube 2 or cartridge, the type that includes a stiff tubular casing. The accessory 3 with its various components is inserted on top of the tube and nested between the caulking tube 2 and the ends of the caulking gun housing 1*c* and 1*d* is held in a predetermined fixed position. This location allows for the user to be able to grasp the forward and lower section of the caulking under normal operation. In this embodiment, as shown in FIG. 2, the accessory 3 is of thermoplastic molded, one piece construction containing fixed components 4, 5, 6, 7, 8, 9, that are shown in plurality; however, not all components need be included, nor their position predetermined as will be shown in additional embodiments. These various holders and wiping surfaces are not limited by number, style, shape or design.

In operation and use, the current invention 3 is placed onto the caulking tube 2 before or after it has been inserted into the barrel 1*e* of the caulking gun 1. When the user squeezes the trigger of the gun, the plunger advances and the caulking cartridge 2 and accessory 3 are locked into the gun 1 by the captive feature 1*c* and 1*d* of conventional caulking gun design. After the user has placed a bead of caulk during the caulking process, he will likely use his finger or shaping tool to spread and smooth the placed caulking. Prior to smoothing or shaping the placed caulk, it is an advantage to wet one's finger with water for acrylic caulks or various spirits or polyurethanes and other such sealants. Included as one of the multiple components, is a replaceable, preferably synthetic sponge 9 that can be moistened or saturated with water or other appropriate liquid, and is conveniently located on the apparatus (retained, e.g., by adhesive or fasteners in this embodiment). Prior to smoothing, the user can wipe his finger or shaping tool across the sponge to aid in this process. During the smoothing process, excess caulk can accumulate either on the user's finger or the shaping tool that is being used. The user may use any number of the semi-rigid or "squeegee like" fins 4 for wiping and collecting the excess caulk. The excess caulk or sealant that has been retained on the fins 4 can easily be removed and cleaned after the caulking process is completed. In a modification (not shown), one of the tool holders 5 or 8 can be made wider to provide a caulk storage reservoir. If the user chooses to use one or more of the shaping tools currently marketed, he can store the shaping tool in one of the tool holders 5, 8 located on the apparatus (even though trough-like holders are shown, variations such as V-shaped or rounded could be included). The tool holders 5 and 8 provide a narrow slot that preferably grips the shaping tools when inserted. If using a tool for shaping of the caulking bead, he can then clean the excess caulk by wiping on fin 4. The user can further clean his finger or tool with a rag, towel, or the like, which is held in one or more of the holes or dispenser like perforations shown in the cleaning fins 4 and 7 which are located to the rear of the device so as not to interfere with the caulking application. When all caulking has been completed, a cap or sealing spout can be removed from the illustrated holder 6 and placed on end of tube 2, sealing for future use. The apparatus, inexpensive in nature, can be cleaned and stored in its operational position, or disposed of in the case of non-water soluble caulks.

FIG. 2 shows Embodiment 1 isometrically, separate from the caulking gun.

Figure 3:
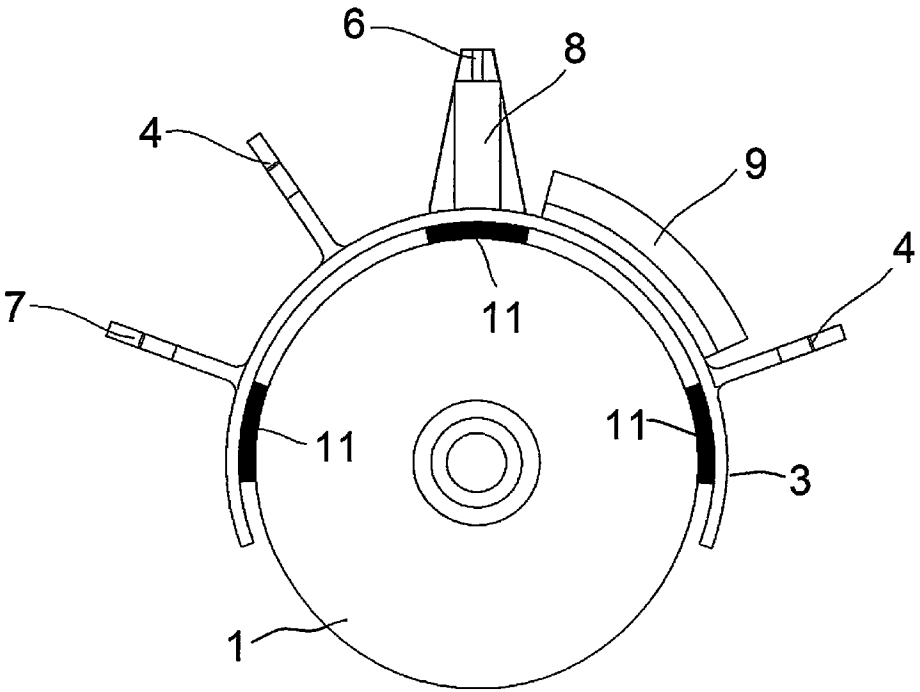
FIG. 3 is an end view of Embodiment 1 showing adhesive strips for attachment to a "sausage" style gun and an example of arrangements of the different components of the current invention.

FIG. 3 is an end view of Embodiment 1 showing various components and adhesive strips 11 running radially or longitudinally on the underside of apparatus 3 for the attachment to "sausage style" caulking guns. The adhesive strips can be permanently fixed to the inside surface of the accessory canopy or shell, with adhesive on the side facing the caulking gun, exposed when release film strips are removed; or they can be double-sided adhesive strips securable to the accessory shell and to the gun when release strips are removed. As these types of commercial guns are designed as full-cylinder canisters receiving a soft pack of caulk, rather than the conventional half barrel or supported framework style caulking guns that receive tubular cartridges, mounting is achieved by peel and stick, Velcro™ (or other), adhering the apparatus 3 with strips 11. The accessory 3 can be either the fixed component style as in Embodiment 1, or an accessory with replaceable, slide-in components as in Embodiment 2 described below.

For epoxies, two cartridges are molded together side-by-side as a single cartridge, for receipt in a double-barreled dispenser gun. For such application the above embodiment (as well as those described below) can be modified so as to be shaped to rest on both cartridges, or configured to rest on only one side of the double cartridge.

Embodiment 2

Figure 4:
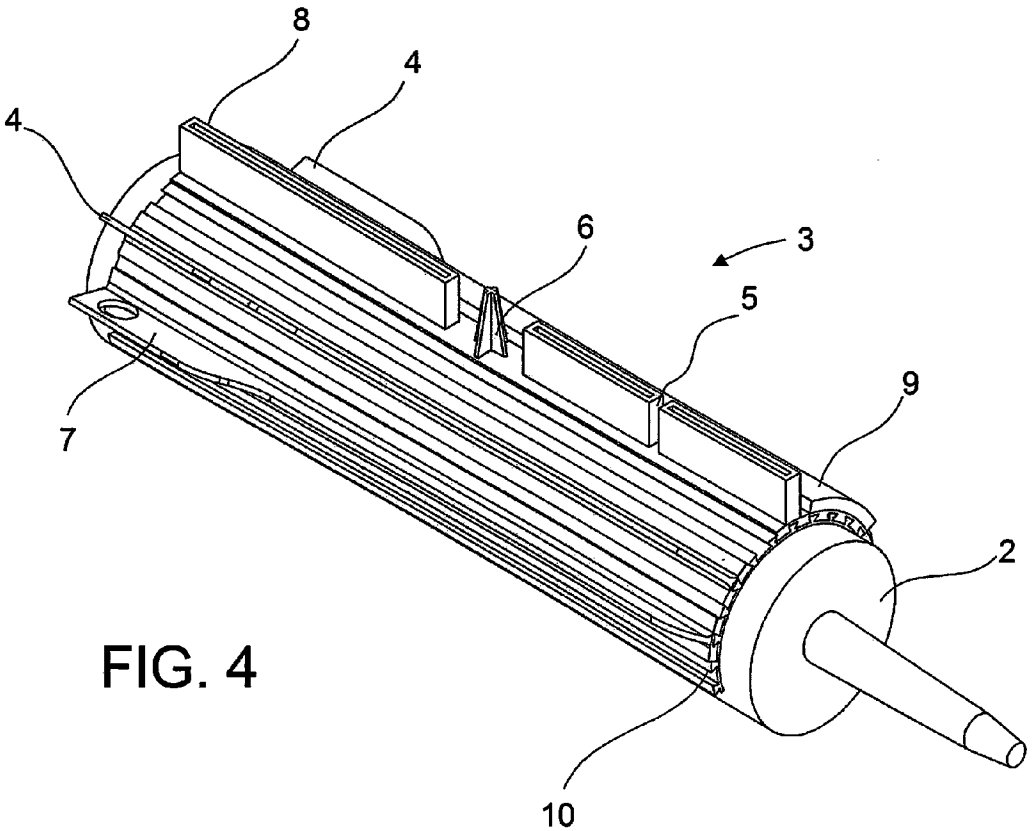
FIG. 4 is an isometric view of the current invention on a caulking gun, showing dovetail splines for attachment of the various replaceable components, in a second embodiment.
Figure 5:
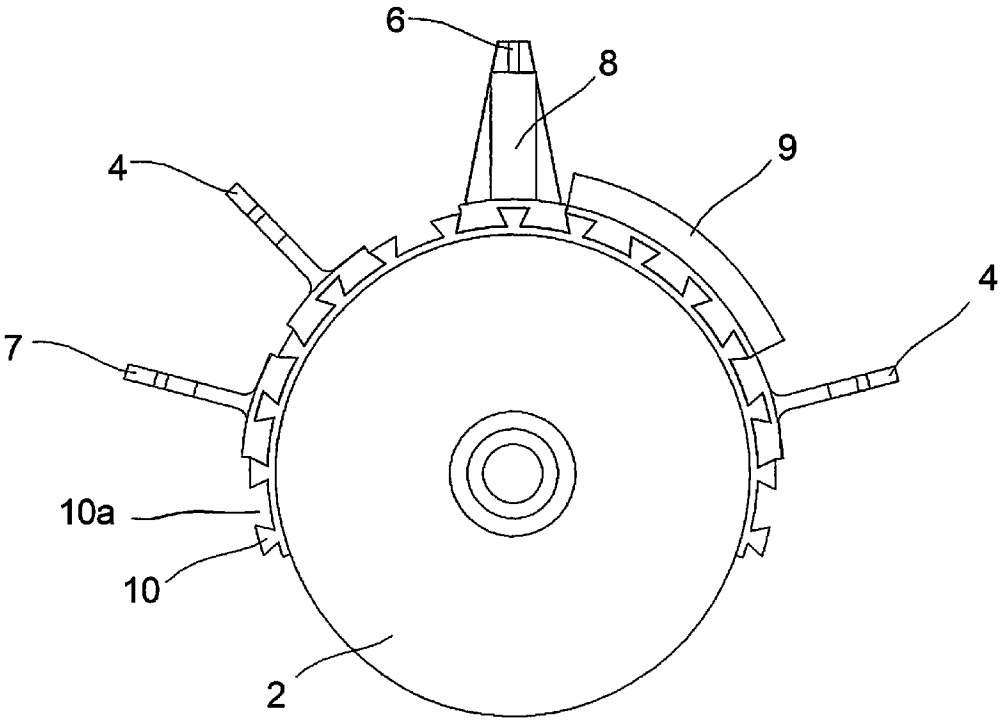
FIG. 5 is a front view of the caulking accessory, shown frictionally held on a disposable cartridge, with "dovetail" splines for attaching replaceable components as shown mounted on the caulking cartridge.
Figure 6:
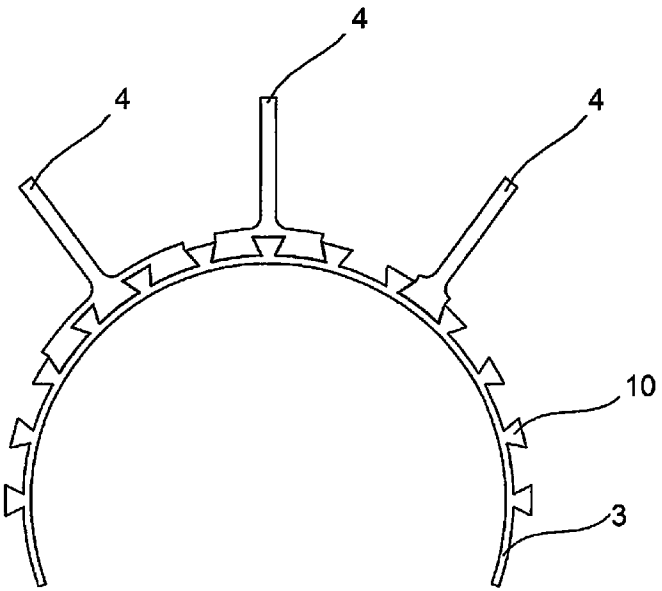
FIG. 6 is a frontal end view of the accessory and various means of attachment of components.

Referring now to FIG. 4, as in Embodiment 1, FIG. 1, the caulking accessory 3 is mounted and held in a fixed position on top of caulking cartridge 2 (or on a "sausage" type caulking gun barrel as in FIG. 3). The caulking gun is not shown in FIG. 4. In this embodiment, dovetail (or other shaped) splines 10 are formed integrally (i.e. integrally molded or extruded) with the accessory 3 on the upper portion of the accessory 3 so that components 4, 5, 6, 7, 8, 9, can be can be inserted singularly or in plurality as the user desires. Design, number and location of components 4, 5, 6, 7, 8, 9, can be interchanged, reused or disposed of at the user's discretion. FIG. 5 is an end view radially displaying the splines 10 and possible component attachment means, including the wiping fins 4, 7, tool holders 5, 8, the cap holder 6 and the sponge 9. Each has a base with a configuration of channels or ridges shaped complementarily to the ridges or channels defined by the splines. FIG. 6 shows additional various means of "dovetail" attachment of the components. However, this means of attachment is not limited by number, style, shape or design. Note that the splines 10 are indicated as ridges, but the channels 10*a* between ridges could be considered the splines. The component bases in any event are complementary and engage slidingly with the splines.

Embodiment 3

Figure 7:
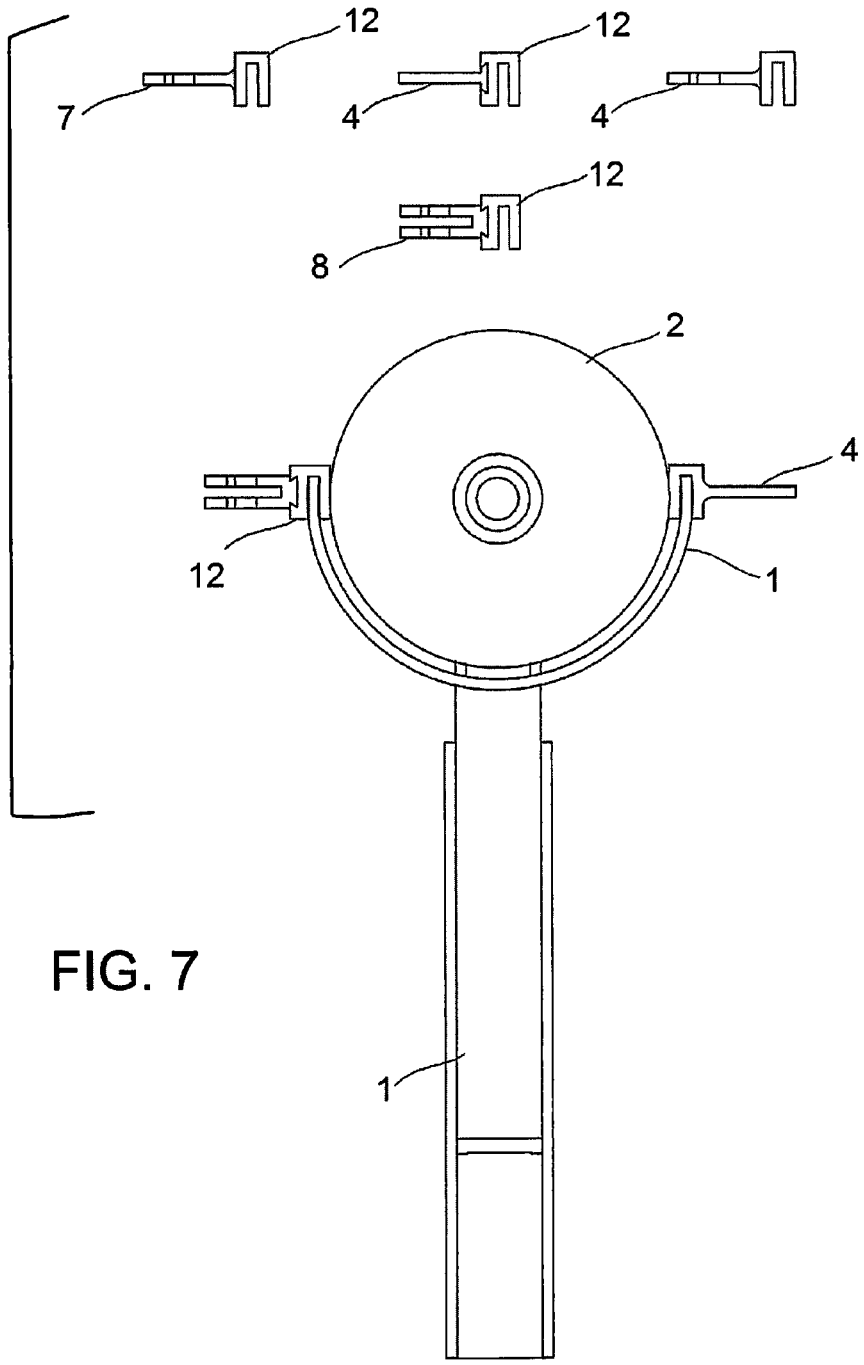
FIG. 7 is a front view of a single, U-shaped frictional "lip" attachment means for a single component, on a "half barrel" style caulking gun, in a third embodiment.

Referring to FIG. 7, discrete components serve as the accessory, each having a base with a U-shaped attachment clip 12, 4, which is frictionally engaged with one or more of the caulking gun 1 sides or frame at the sides of the opening, without extending over the top of the caulk tube as described above. As in Embodiment 2, the components are interchangeable and can be either one piece, as in 7, or of removable design as in 12, 8. Not shown is a side view demonstrating the length of the clip, which can be either full length of the lip, or any portion thereof. These components can include each of the features described above, including the sponge and cap retainer as well as the other components.

Embodiment 4

Figure 8:
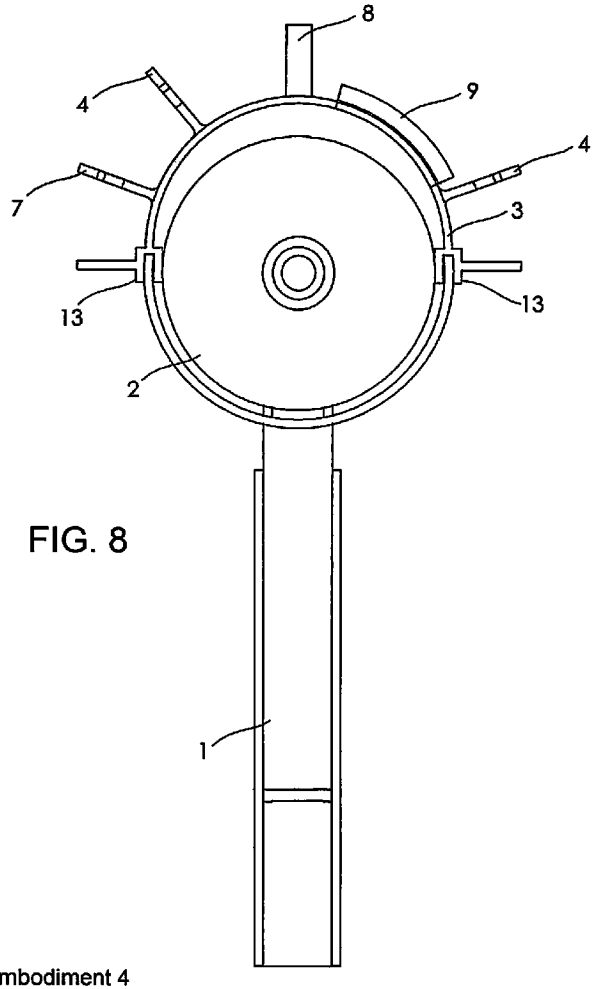
FIG. 8 is a front view of the apparatus in a fourth embodiment with dual, U-shaped receiving lips on the accessory for frictional attachment to a "half barrel" style caulking gun.

FIG. 8 is a front view of the apparatus with dual, U-shaped clips 13, integrally formed with the accessory 3 and frictionally held onto the caulk gun barrel. In this embodiment, the accessory 3 is attached to the gun 1 frame, rather than "piggybacking" on top of the cartridge as in Embodiment 1. The clips 13 can be intermittent or continuous. This embodiment can be one piece construction as in Embodiment 1, or with splines and replaceable components as in Embodiment 2. Unlike the previous embodiments, the apparatus 3 is attached to the caulking gun 1 after the caulking cartridge 2 has been inserted into the caulking gun 1.

Embodiment 5

Figure 9A:
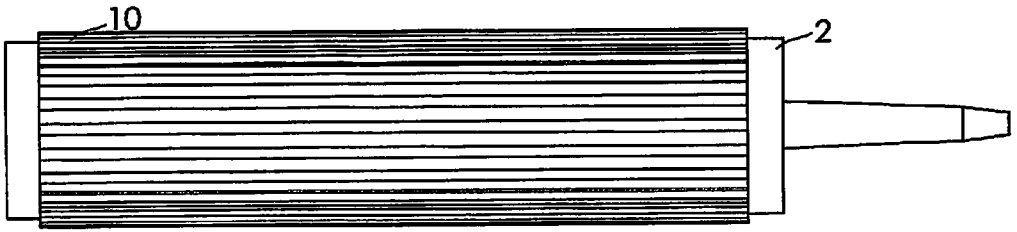
FIGS. 9A-9D show side and front views of a fifth embodiment, in the form of a new style of disposable caulking cartridge.
Figure 9B:
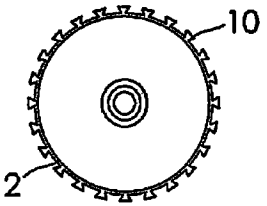

This embodiment refers to a new design in the manufacture of prior art disposable tubular casing caulk cartridges or cartridges of fluent material used in other fields and industries. Referring to FIGS. 9A and 9B, dovetail splines 10 are formed integrally with the caulking cartridge 2 during the manufacture of the cartridge itself. These splines 10 are designed to receive the interchangeable components described above in Embodiment 2. The splines can be thermally formed.

Figure 9C:
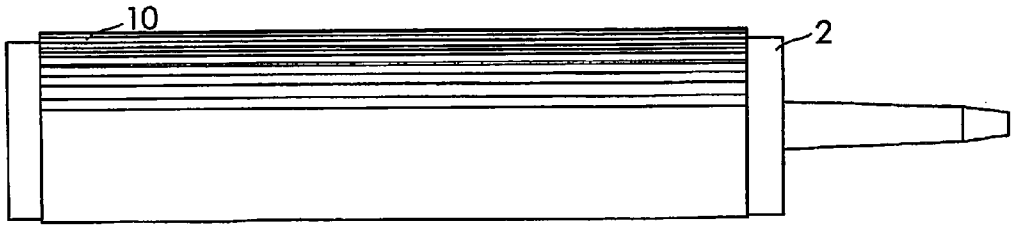
Figure 9D:
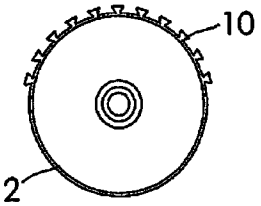

FIGS. 9C and 9D show these same splines 10 only on the top half of the cartridge.

Embodiment 6

Figure 10A:
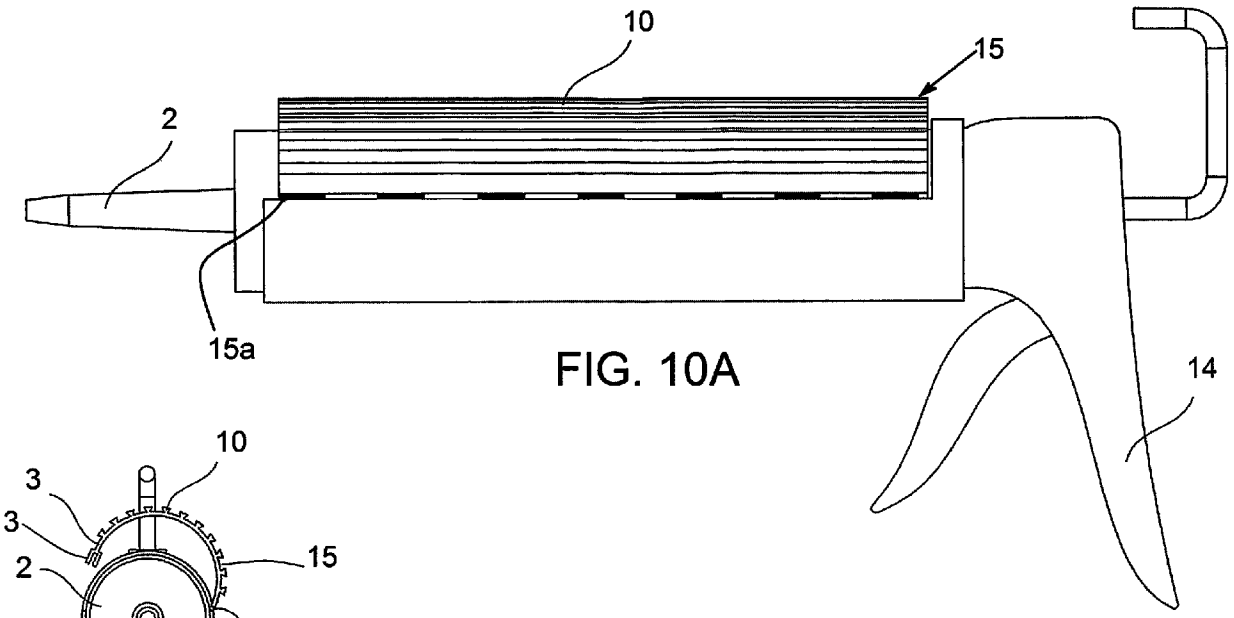
FIGS. 10A and 10B show side and front views of a new caulking gun design in a sixth embodiment, with a pivoting plastic lid cover including dovetail splines fully and partially covering the caulking tube, for engaging various tools and components.
Figure 10B:
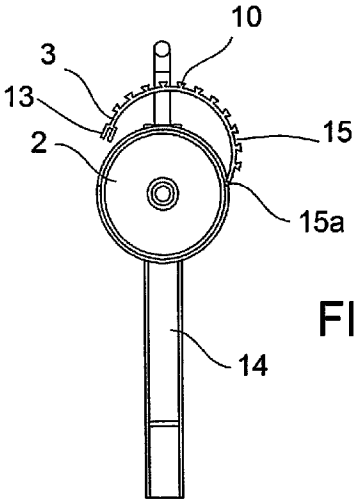
Figure 11A:
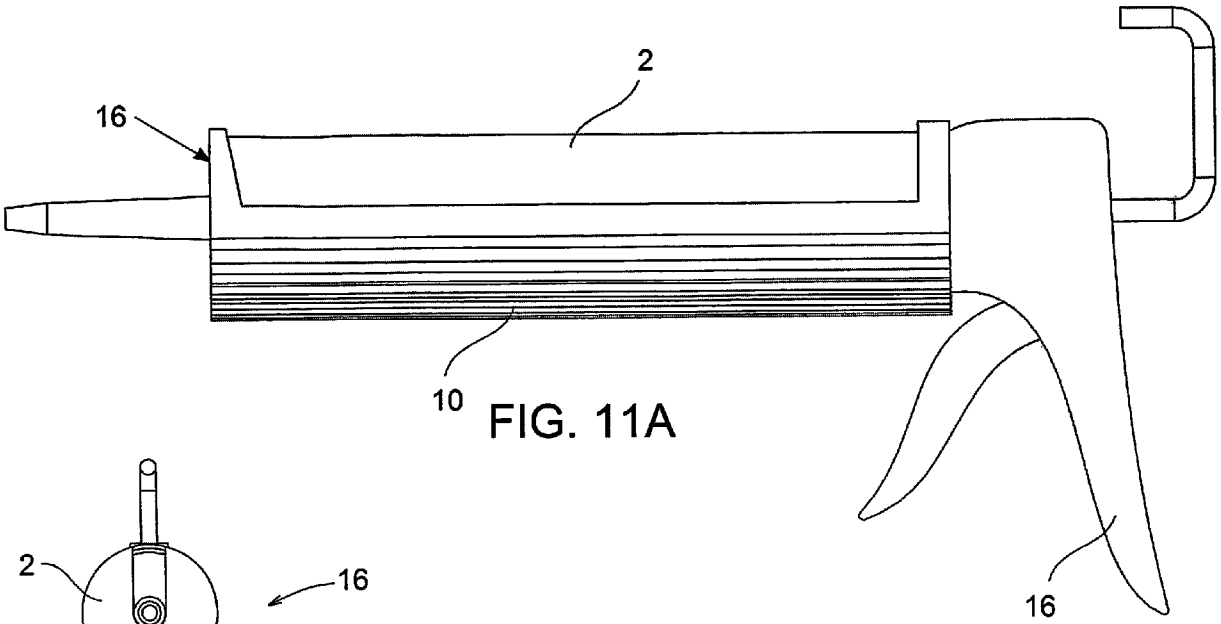
FIGS. 11A, 11B, 12A and 12B are side and front views of a seventh embodiment, a new style caulking gun with splines incorporated into a prior art "half-barrel" style caulking gun, showing the splines at lower and upper positions.
Figure 11B:
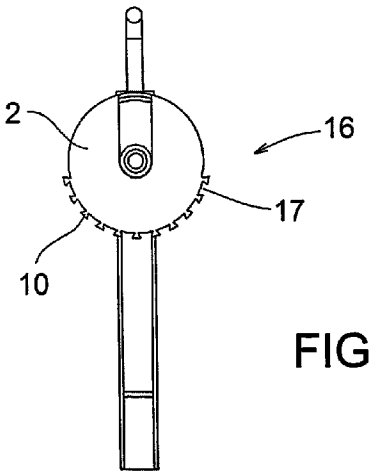
Figure 12A:
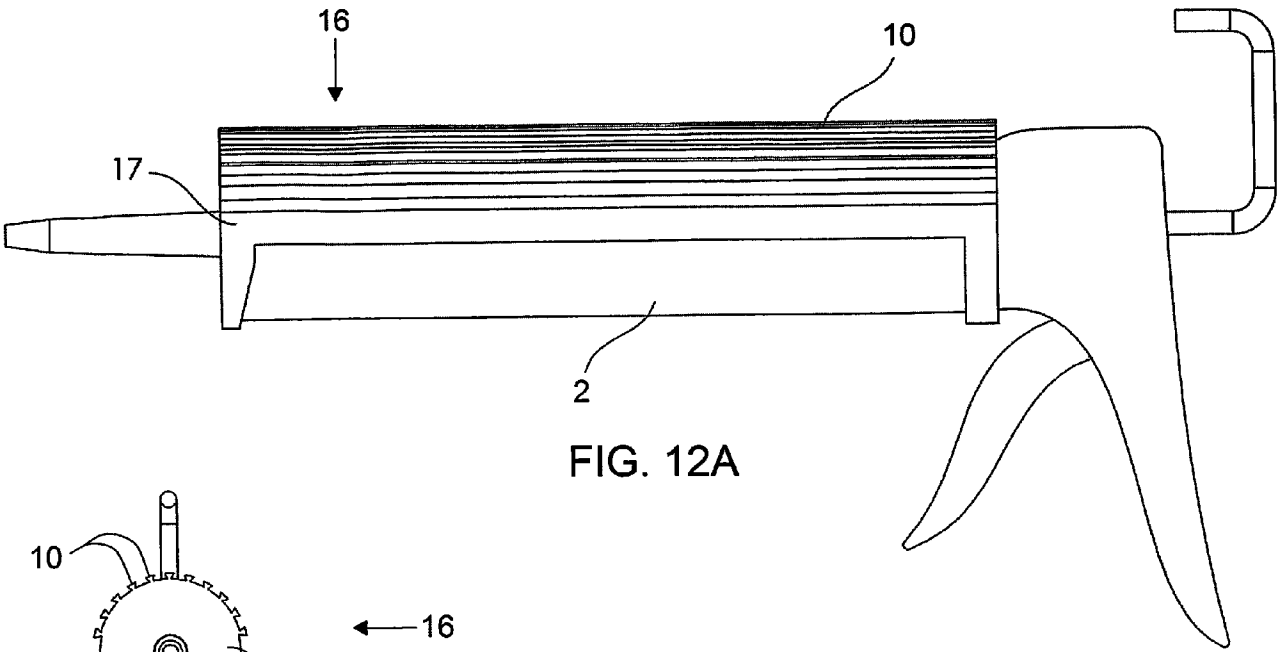
Figure 12B:
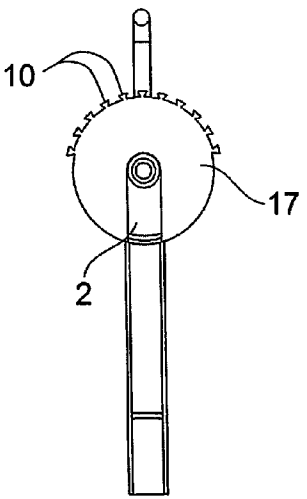

FIG. 10 shows a front and side view of a modified style caulking gun 14. In FIG. 10, an openable, partial-cylindrical lid or canopy 15 is shown running longitudinally the length of the caulking gun and can incorporate either fixed, as in Embodiment 1, or removable fins or attachments 4, 5, 6, 7, 8, 9 (not shown) as in previous embodiments can be inserted. The splines 10 can be produced by thermally forming or extruding them into the body of the "half barrel" canopy accessory as it is manufactured. The canopy can be hinged or pivoted on the barrel, as indicated at 15*a* on the right side of FIG. 10B, and it can have a U-shaped clip 13 (intermittent or continuous) to engage the barrel edge on the other side.

Embodiment 7

FIGS. 11A, 11B, 12A and 12B are front and side views of a modified caulking gun 16 wherein splines 10 are incorporated into the barrel 17 underside or upper side of a caulking gun, allowing for replaceable implements or components to be inserted having the same functions as Embodiment 2.

The splines 10 are manufactured into the underside or upper side of a "half-barrel" 17 or can be permanently affixed by other means, where removable fins and accessories 4, 5, 6, 7, 8, 9 as in previous embodiments can be inserted. The splines can be produced by thermally forming or extruding them into the plastic of the cartridge gun as it is manufactured. The illustrated caulk gun can have a rotatable barrel 17 as known in the prior art, so as to be positionable as in FIGS. 11A and 11B, or as in FIGS. 12A and 12B.

References herein to caulk and caulk cartridges are to be understood as also encompassing other fluent materials such as other sealants, epoxies, etc.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. In a caulking gun assembly including a caulking gun having a squeeze handle, an actuator responsive to the squeeze handle, and a barrel, and a caulk cartridge containing fluent caulk material positioned in the barrel, the improvement comprising:

an accessory secured to the caulking gun assembly and extending at least part of the length of the barrel, the accessory including at least one wiper fin extending outwardly from the caulking gun assembly and positioned for wiping excess caulk from fingers, tools or other caulk shaping implements, a tool holder configured to receive and retain a caulk shaping tool, and a sponge capable of retaining moisture, wherein the barrel of the caulking gun has an open top side and the caulk cartridge is a tubular casing caulk cartridge positioned in the barrel such that a portion of the cartridge is exposed at said open top side, and wherein the accessory comprises a partial-cylindrical plastic canopy having two longitudinal edges and of an internal diameter essentially the same as an external diameter of the cartridge so that the canopy engages over and resides against the cartridge at said open top side of the barrel, each of the two longitudinal edges being engaged and extending a short distance between the cartridge and the caulking gun barrel, such that the accessory resides essentially only at the open top side of the barrel, and the accessory being engaged under top flanges of the barrel at front and back ends of the open top side, to thereby retain the accessory on the caulking gun assembly, whereby a user of the caulking gun assembly can complete a process of shaping and smoothing dispensed caulk in a clean and efficient manner, by removing and storing excess caulk from the user's fingers or shaping tools, which can be stored on the accessory, and by wetting the user's finger or a shaping tool using the sponge before or after smoothing the dispensed caulk.

2. The caulking gun of claim 1, wherein the accessory is formed of molded plastic material.

3. The caulking gun of claim 1, wherein the accessory further includes a rag holder.

4. In a caulking gun assembly including a caulking gun having a squeeze handle, an actuator responsive to the squeeze handle, and a barrel, and a caulk cartridge containing fluent caulk material positioned in the barrel, the improvement comprising:

an accessory secured to the caulking gun assembly and extending at least part of the length of the barrel, the accessory including an attached component comprising: a wiper fin extending outwardly from the caulking gun assembly and positioned for wiping excess caulk from fingers; a tool holder configured to receive and retain a caulk shaping tool; a sponge capable of retaining moisture; or a rag holder, wherein the accessory comprises a partial-cylindrical plastic canopy having an exterior formed into a series of parallel splines extending in longitudinal direction, each spline being a shaped channel or ridge, and the wiper fin and the tool holder each having a base with one or more ridges or channels complementarily shaped to the splines on the partial-cylindrical plastic canopy so that the bases of the wiper fin and tool holder slidingly engage with the splines and are held on the partial-cylindrical plastic canopy by the splines, whereby a user of the caulking gun assembly can complete a process of shaping and smoothing dispensed caulk in a clean and efficient manner using the accessory, by using the wiper fin to remove excess caulk from the user's fingers or shaping tools, by storing tools in the tool holder, or by wetting the user's fingers or a shaping tool using the sponge before or after smoothing the dispensed caulk.

5. The caulking gun assembly of claim 4, wherein the accessory includes a plurality of wiper fins and a plurality of tool holders.

6. The caulking gun assembly of claim 4, wherein the accessory further includes a cap holder for receiving and retaining a cap of the caulk cartridge.

7. The caulking gun assembly of claim 4, including a tool holder comprising an elongated slot of a width to engage a caulk shaping tool inserted in the slot.

8. The caulking gun assembly of claim 4, wherein the accessory is formed of molded plastic material.

9. The caulking gun assembly of claim 4, wherein the accessory includes a tool holder which can serve as a reservoir for excess caulk.

10. The caulking gun assembly of claim 4, wherein the accessory includes a rag holder, and a cap holder for receiving and retaining a cap of the caulk cartridge, along with a plurality of said wiper fins and tool holders.

11. The caulking gun assembly of claim 4, wherein the accessory includes a rag holder.

12. The caulking gun assembly of claim 11, wherein the rag holder comprises a hole in the wiper fin.

* * * * *